US006513536B1

(12) United States Patent
Demellier et al.

(10) Patent No.: US 6,513,536 B1
(45) Date of Patent: Feb. 4, 2003

(54) ROTARY HOLDER

(75) Inventors: Stéphane Demellier, Talloires (FR); Pierre Joulia, Saint Jorioz (FR)

(73) Assignee: Demellier Joulia SARL, Doussard (FR)

( * ) Notice: Subject to any disclaimer, the term of this patent is extended or adjusted under 35 U.S.C. 154(b) by 22 days.

(21) Appl. No.: 09/642,777

(22) Filed: Aug. 22, 2000

(30) Foreign Application Priority Data

Aug. 23, 1999 (FR) ..... 99 10822

(51) Int. Cl.[7] ..... A45D 40/24
(52) U.S. Cl. ..... 132/318
(58) Field of Search ..... 132/297, 318; 401/61, DIG. 1

(56) References Cited

U.S. PATENT DOCUMENTS

| | | | | |
|---|---|---|---|---|
| 2,309,000 A | | 1/1943 | Morrison | |
| 2,521,140 A | * | 9/1950 | Abbotts | 401/61 |
| 2,523,457 A | | 9/1950 | Thompson et al. | |
| 3,416,868 A | * | 12/1968 | Landen | 401/61 |
| 6,035,866 A | * | 3/2000 | Seneco et al. | 132/318 |

FOREIGN PATENT DOCUMENTS

| | | |
|---|---|---|
| EP | 0865743 A3 | 9/1998 |
| EP | 0865743 A2 | 9/1998 |
| FR | 929031 A | 12/1947 |
| FR | 985750 A | 7/1951 |
| FR | 1336295 A | 12/1963 |

* cited by examiner

*Primary Examiner*—Todd E. Manahan
(74) *Attorney, Agent, or Firm*—Greenblum & Bernstein, P.L.C.

(57) ABSTRACT

A rotary holder, particularly for a cosmetic product, which includes a base, a pivoting body pivotally mounted on the base, a cursor driven in longitudinal translation by rotational movement of the pivoting body, and a closing cap adapted to be affixed to the pivoting body due to complementary fixing mechanisms. The complementary fixing mechanisms facilitate connection between the cap and the pivoting body along a longitudinal axis of the holder, which prevents respective translation between the cap and the pivoting body, and which leaves the cap free to rotate with respect to the pivoting body about the longitudinal axis.

19 Claims, 5 Drawing Sheets

(BA)

ROTARY HOLDER

CROSS-REFERENCE TO RELATED APPLICATIONS

The instant application is based upon French Patent Application No. 99 10822, filed Aug. 23, 1999, the disclosure of which is hereby incorporated by reference thereto in its entirety, and the priority of which is hereby claimed under 35 U.S.C. §119.

BACKGROUND OF THE INVENTION

1. Field of the Invention

The present invention relates to an improvement for rotary holders of the types used for storing cosmetic products such as lipsticks or various lip creams. It relates more particularly to the construction of the fixing arrangement between the holder body and the closing cap.

2. Description of Background and Relevant Information

A large number of rotary holder mechanisms are known from the prior art, such as those in which the holder body is formed of a base and a rotatable body, and in which the rotation of the rotatable body with respect to the base drives a cursor that carries the cosmetic product in longitudinal translation, the holder body receiving a closing cap to ensure the protection of the product and possibly the imperviousness of the rotary holder.

However, these prior art rotary holders have certain disadvantages related to the construction of the arrangement which fixes together the holder body and the closing cap. This arrangement, or the fixing mechanisms, generally leave the rotatable body free to rotate with respect to the base when the closing cap is fixed to the holder body, thus causing the discharge of the product in the tip of the closing cap. Moreover, the rotation between the base and the rotatable body is generally caused by the closing cap whose wedging by longitudinal ribs on the holder body generates this undesirable rotation that is capable of damaging the cosmetic product.

SUMMARY OF THE INVENTION

Thus, an object of the present invention is to overcome the aforementioned disadvantages by using a simple, reliable, and inexpensive constructional arrangement. This object of the invention is to make it possible to provide a rotary holder whose mechanism for extracting the product cannot be accidentally or inadvertently actuated when the holder is closed, thus protecting the product from any ill-timed discharge, and preventing it from being damaged by the closing cap.

Thus, according to a main characteristic of the rotary holder of the invention, especially for a cosmetic product, the holder is of the type having a base on which is rotatably mounted a rotatable body whose rotating movement with respect to the base drives a cursor in longitudinal translation, the holder also having a closing cap adapted to be affixed to the rotatable body due to a complementary fixing mechanism, and the complementary fixing mechanism makes it possible to affix the cap and the rotatable body to one another along the longitudinal axis of the holder, preventing the respective translation between the two elements, and leaving the cap free to rotate with respect to the rotatable body about this longitudinal axis.

According to the preferred embodiment of the rotary holder of the invention, the complementary fixing mechanism is constituted by a male fixing element located on the closing cap and a female fixing element arranged on the rotatable body.

According to this preferred embodiment of the rotary holder, the closing cap includes, in its enclosure, an inner wall portion that extends downwardly, perpendicular to its upper wall, and which carries the male fixing element.

According to another characteristic of the rotary holder of the invention, the female fixing element is constituted by a peripheral edge located at the upper end of the peripheral wall forming the rotatable body and extending toward the inside of this body.

According to a complementary characteristic of the rotary holder, the male element is formed by an annular bead.

According to an alternative embodiment of the rotary holder of the invention, the male element is formed by clipping studs.

According to another embodiment of the rotary holder, the complementary fixing mechanism is constituted by a female fixing element located on the closing cap and a male fixing element located on the rotatable body.

According to this other embodiment of the rotary holder of the invention, the female element is constituted by an annular groove located at the lower end of the cap on the inner surface of its peripheral wall, and the male -element is constituted by an annular bead arranged on the outer surface of the peripheral wall forming the rotatable body.

According to a complementary characteristic of the rotary holder of the invention, the rotatable body and the closing cap are made of plastic, and the complementary fixing mechanism of the male element and of the female element cooperate by clipping.

According to another characteristic of the rotary holder of the invention, the closing cap has, in its enclosure, an inner wall portion that at least partially carries the complementary fixing mechanism.

BRIEF DESCRIPTION OF DRAWINGS

Other characteristics and advantages of the invention will become apparent from the description that follows, with reference to the annexed drawings which are only provided by way of non-limiting examples, and in which:

FIGS. 1*a*–7 show the preferred embodiment of the rotary holder and alternative embodiments thereof;

FIG. 1*a* is a longitudinal cross-sectional view of the holder body of the rotary holder in the deployed position;

FIG. 2 is a longitudinal cross-sectional view of the closing cap of the rotary holder;

FIG. 3 shows, in a view similar to FIG. 2, a first alternative embodiment of the closing cap;

FIG. 4 is a longitudinal cross-sectional view of the first embodiment of the rotary element in the closed position;

FIG. 5 shows, in a view similar to FIG. 1*b*, a second embodiment of the holder body;

FIG. 6 is a longitudinal cross-sectional view of the closing cap of the second embodiment of the rotary holder; and FIG. 7 shows, in a view similar to FIG. 4, the second embodiment of the rotary holder in the closed position.

DETAILED DESCRIPTION OF THE INVENTION

Figure 1A:
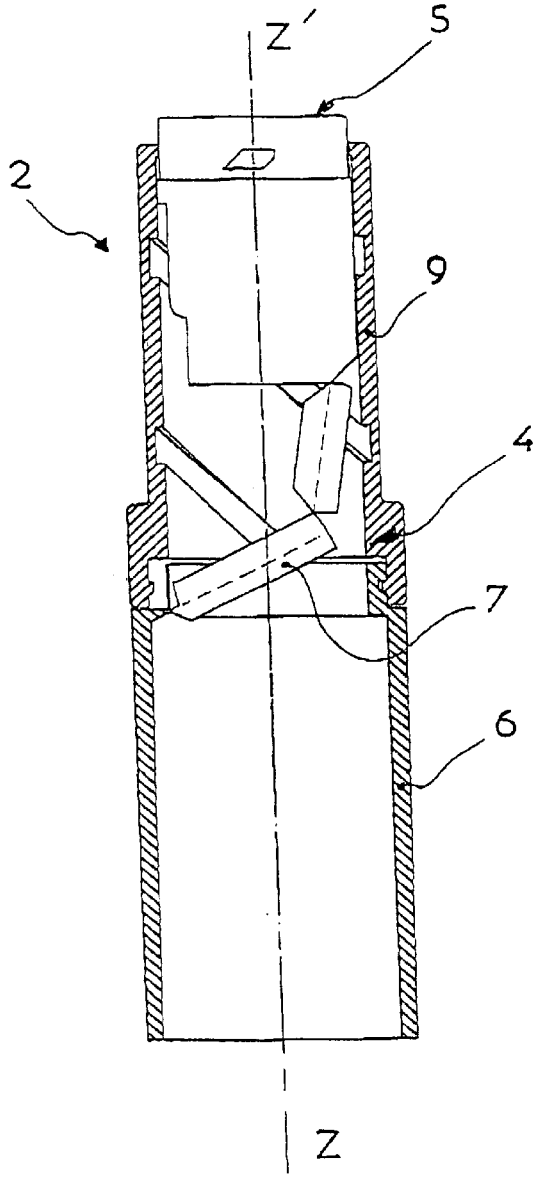
Figure 1B:
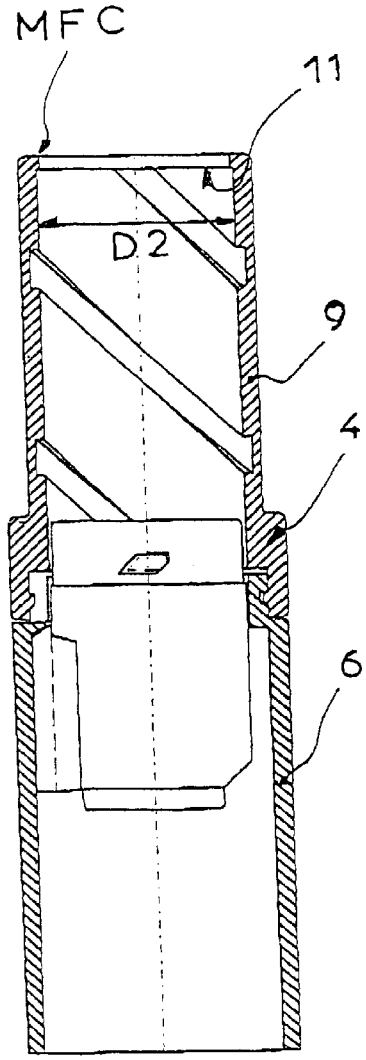
FIG. 1*b* shows, in a view similar to FIG. 1*a*, the holder body in the retracted position.

According to the invention, the rotary holder generally designated by the reference numeral 1 is of the type constituted by a holder body 2 that includes the mechanism itself and the product, such as lipstick, for example, and by a closing cap 3 adapted to be fixed to the holder body 2. The holder body 2 has a base 6 and a rotatable body 4 that is capable of rotating with respect to the base 6 so as to cause, in a known manner, the longitudinal translational movement of a cursor 5 that carries the cosmetic product. According to the embodiment shown, the base 6 and cursor 5 form a single element; however, it could be otherwise, and the cursor could be provided as independent of the base 6 in a known manner.

According to the invention, the closing cap 3 is adapted to be affixed to the holder body 2, and more particularly to the rotatable body 4 due to complementary fixing mechanisms (MFC) arranged on the cap 3 and the rotatable body. These complementary fixing mechanisms (MFC) make it possible to affix the closing cap 3 to the rotatable body 4 so as to leave the cap 3 free to rotate with respect to the rotatable body 4, while preventing the longitudinal translation between these two elements.

The fixing occurs directly between the closing cap 3 and the rotatable body 4, in order to affix them to one another without requiring complementary elements, the fixing mechanisms (MFC) being carried by the rotatable body 4 and the cap 3.

According to the preferred embodiment of the rotary holder 1 of the invention, the complementary fixing mechanism (MFC) is obtained by clipping, i.e., an elastic friction-fit connection, between a male element 10 and a female element 11 whose cooperation prevents the longitudinal translation along the longitudinal axis Z-Z', but allows the free rotation about this longitudinal axis to enable the closing cap 3 to rotate freely without driving the rotatable body 4 in rotation with respect to the base 6.

Figure 2:
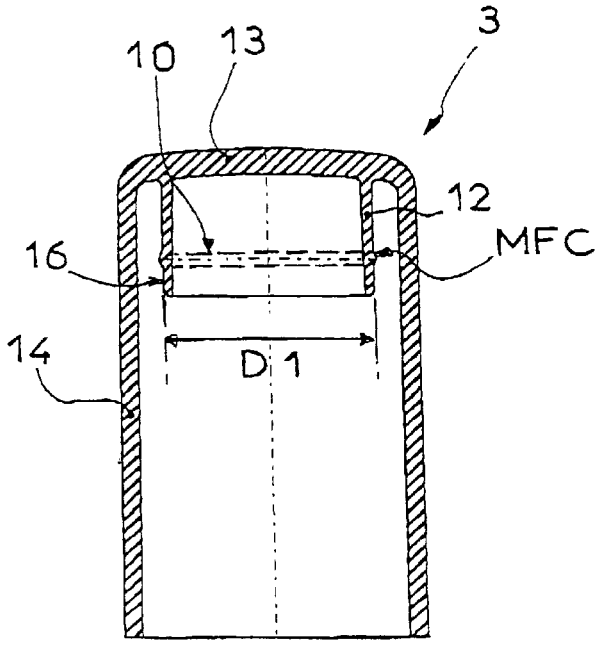
Figure 3:
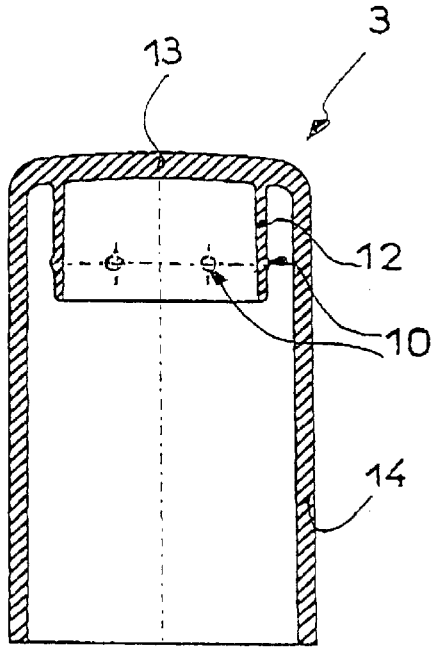
Figure 4:
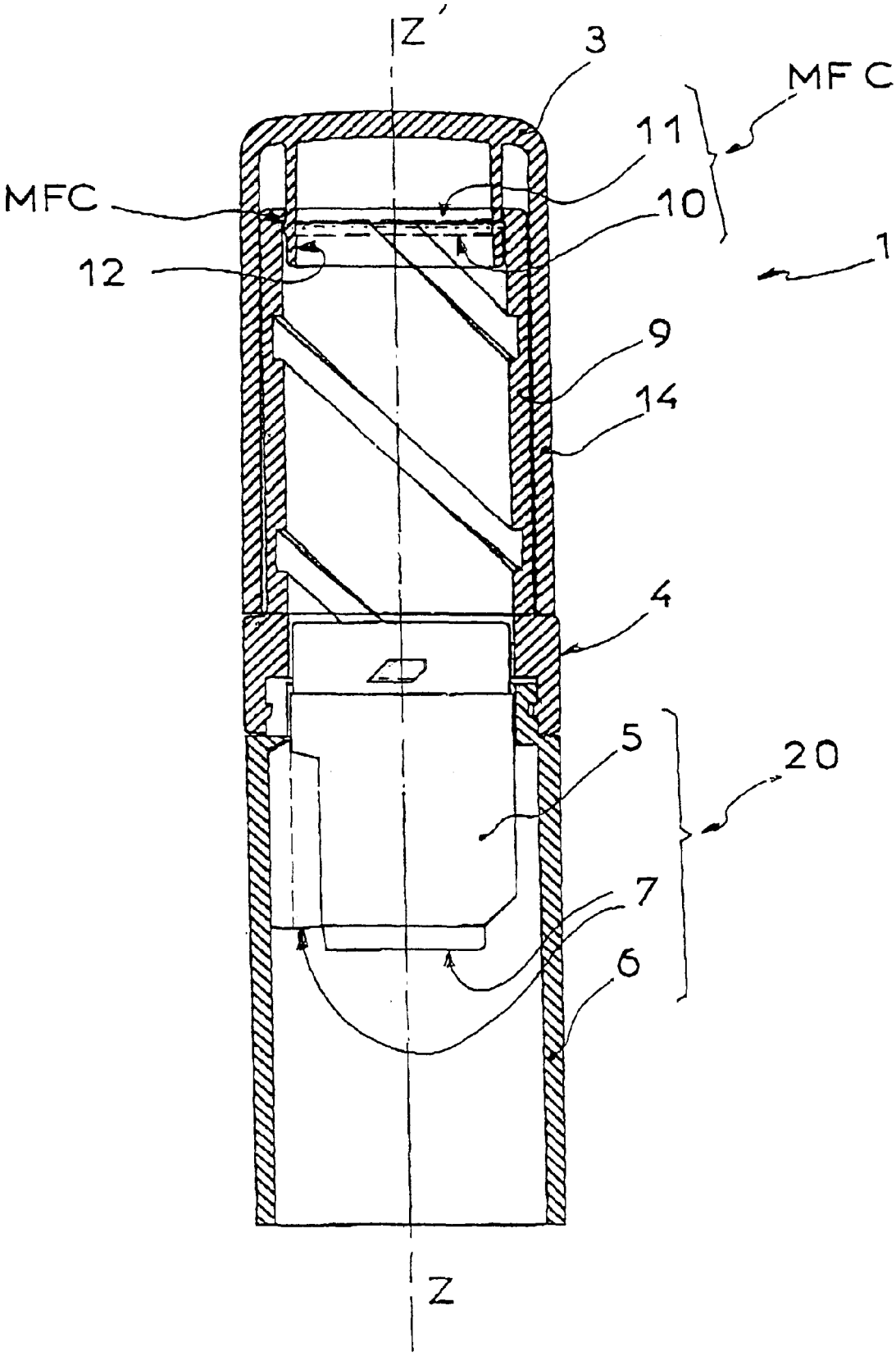

According to the preferred embodiment shown in FIGS. 1*a*–4, the cap 3 has the male fixing element 10; it is located on the outer surface 16 of an internal wall extension 12 that projects downwardly (BA) in the enclosure of the cap 3, from the upper wall 13 of the cap 3. The internal extension 12 is advantageously formed of a cylindrical wall portion whose outer diameter D1 corresponds, except for the clipping clearance, to the inner diameter D2 of the rotatable body 4. The male fixing element 10 is constituted by a peripheral annular bead arranged substantially at the end of the internal wall extension 12, as shown in FIG. 2; it is adapted to clip itself against the female element 11 arranged on the inner surface of the rotatable body 4 and formed advantageously by an upper peripheral edge, as shown in FIG. 1*b* and FIG. 4.

According to the embodiment of the rotary holder 1, the female element 11 is therefore provided as a peripheral edge located at the upper end of the cylindrical wall 9 forming the rotatable body 4 and extending directly toward the inside thereof. It is to be understood, as shown in the alternative embodiment of the closing cap 3 shown in FIG. 3, that the male element 10 can have a different configuration and can be formed by clipping studs, i.e., localized projections, for example, which extend along the periphery of the internal wall extension 12. Similarly, the male fixing element could be arranged on the inner surface of the rotatable body 4, whereas the female element would be arranged on the inner extension of the cap 3, without leaving the scope of protection of the invention.

Thus, when the cap 3 is closed on the holder body 2, the internal wall extension 12 of the cap 3 comes to position itself in the inner bore of the rotatable body 4, as shown in FIG. 4. The annular bead 10 clips itself right beneath the annular edge 11 of the rotatable body 4 to prevent the longitudinal translation between the rotatable body 4 and the cap 3 by allowing a degree of rotation therebetween.

It can be noted that the clipping occurs advantageously due to the elastic deformation of the inner wall 12 of the cap 3 and/or to that of the end of the peripheral wall 9 of the rotatable body 4. To this end, these elements are made of plastic and can be made by injection, for example.

The inner wall of the closing cap 3 could carry the female element, and the bore of the rotatable body 4 the male element without leaving the scope of protection of the invention. According to this embodiment and a variation, the inner wall of the closing cap 3 at least partially carries the complementary fixing mechanism (MFC), i.e., either the male element or the female element. According to the embodiment of the invention shown, the inner wall 12 has a completely cylindrical shape and extends from the upper wall of the cap 3. However, it could be otherwise, and this wall could, for example, be formed of a plurality of cylindrical wall portions, or even have a different shape; it could also extend from the cylindrical, outer peripheral wall of the cap, and not from its upper wall, without leaving the scope of protection of the invention.

Figure 5:
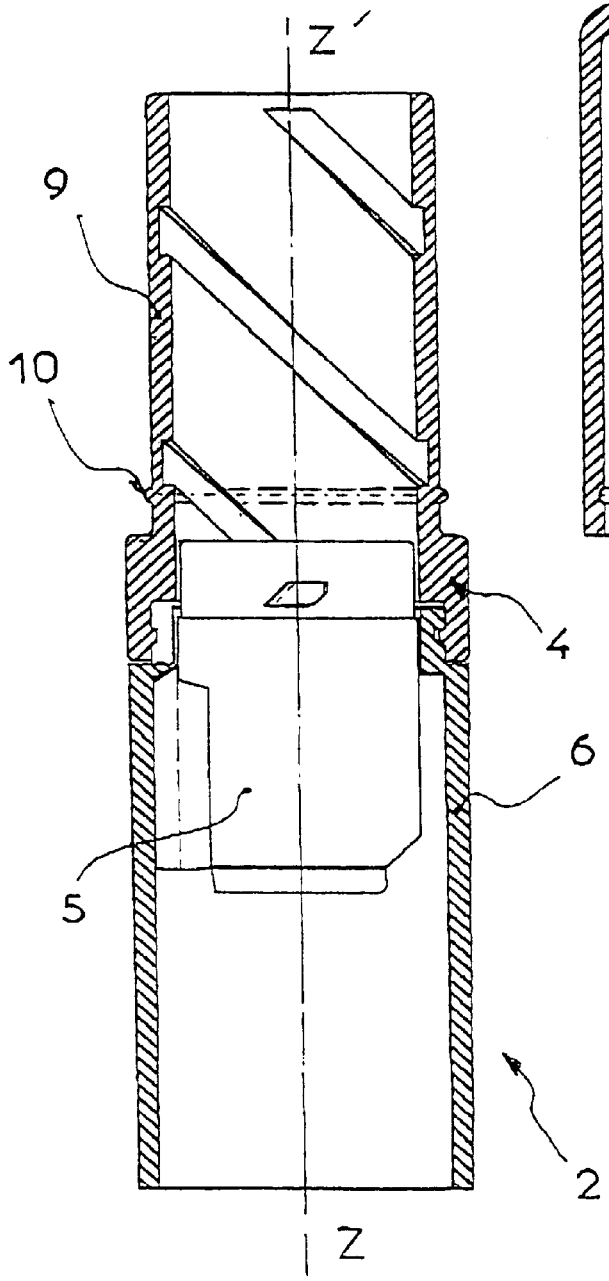
Figure 6:
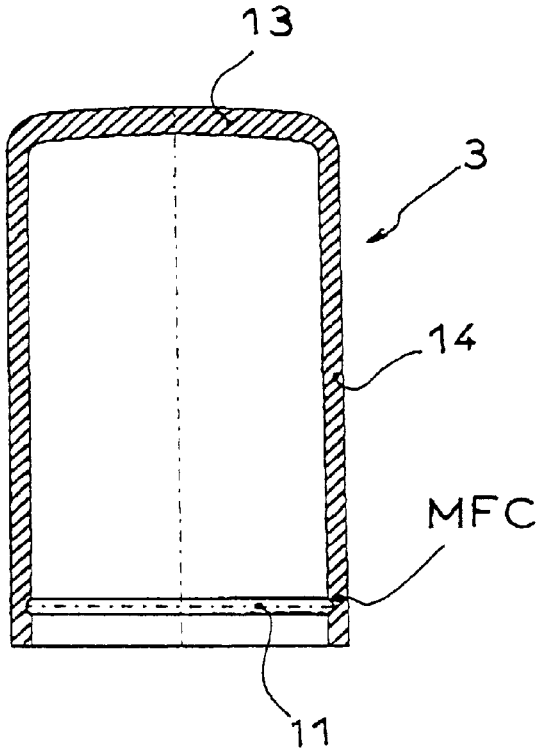
Figure 7:
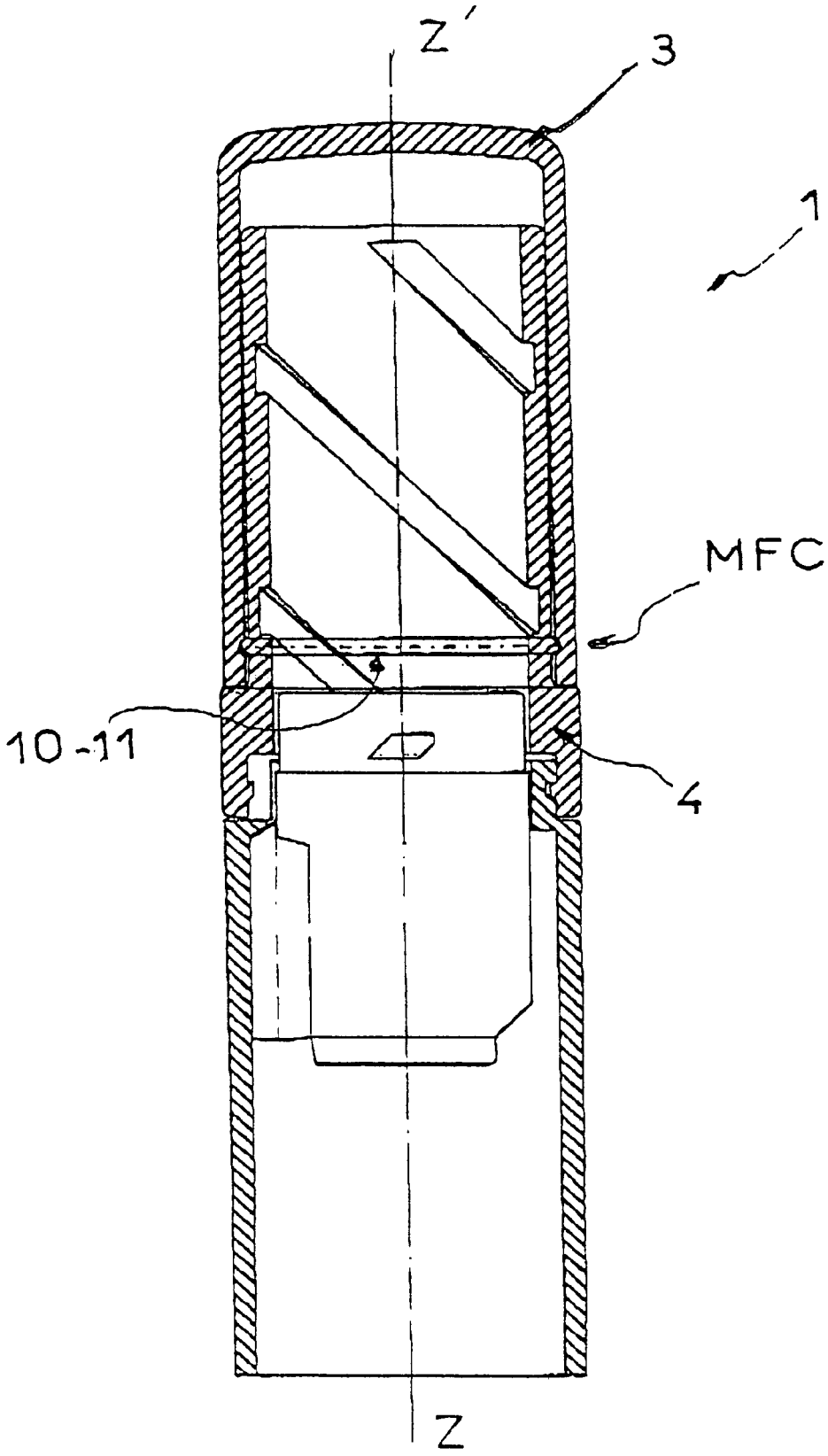

According to an alternative embodiment of the invention shown in FIGS. 5–7, the male and female fixing elements 10, 11 are arranged on the outer surface of the wall 9 of the rotatable body 4 and on the inner surface of the peripheral wall 14 of the cap 3, respectively. The male element is formed by an annular bead 10 located on the outer surface of the rotatable body 4, in the lower portion thereof, whereas the corresponding female element 11 is formed of an annular groove located in the inner surface of the peripheral wall 14 of the cap 3, in the vicinity of the lower end of the cap 3. The groove 11 and the bead 10 have similar transverse profiles; during their cooperation, they enable the rotation between the cap 3 and the rotatable body 4 which carries them while preventing their separation by the longitudinal translation. This separation is obtained by forcing the unlocking of these fixing mechanisms in a known manner.

According to the embodiments shown, the rotary holder is made in three pieces, namely, a cap 3, a rotatable body 4, and a carrying assembly 20 formed of the base 6, cursor 5, and hinge elements 7 blocking the cursor 5 in rotation with respect to the base 6 so as to enable, in a known manner, its longitudinal movement during the respective rotation between the rotatable body 4 and the base 6. However, it is to be understood that the complementary fixing mechanisms described in the invention could be used for holders where the carrying assembly 20 is made in a plurality of pieces.

The invention is not limited to the specific details of the embodiments described and shown by way of examples, but also includes all of the technical equivalents as well as their combinations.

What is claimed is:

1. A rotary holder for a cosmetic product, comprising:

a base;

a rotatable body that is rotatably mounted on the base;

a cursor which is driven in longitudinal translation by rotational movement of the rotatable body;

a closing cap which is directly and removably affixable to the rotatable body;

complementary fixing mechanisms allowing the closing cap to be removably and directly affixed to the rotatable body; and the complementary fixing mechanisms facilitating affixation between the closing cap and the rotatable body with respect to a longitudinal axis of the holder and preventing respective translation between the closing cap and the rotatable body, wherein, when the closing cap is installed on the rotatable body, the closing cap is free to rotate about the longitudinal axis, and wherein the closing cap comprises an inner cylindrical wall and an outer cylindrical wall, the inner cylindrical wall portion comprising one complementary fixing mechanism of the complementary fixing mechanisms.

2. The rotary holder of claim 1, wherein the complementary fixing mechanisms comprise a male fixing element located on the closing cap and a female fixing element arranged on the rotatable body.

3. The rotary holder of claim 2, wherein the male element comprises at least one of an annular bead, clipping studs, and projections.

4. The rotary holder of claim 2, wherein the rotatable body and the closing cap are made of plastic, and wherein each of the male element and the female element engage each other.

5. The rotary holder of claim 1, wherein the closing cap comprises an inner wall portion which extends downwardly from an upper wall portion.

6. The rotary holder of claim 5, wherein the male fixing element is arranged on the inner wall portion.

7. The rotary holder of claim 5, wherein the female fixing element is arranged on a peripheral wall of the rotatable body.

8. The rotary holder of claim 7, wherein the female fixing element is arranged on a peripheral edge that is located at an upper end of the peripheral wall of the rotatable body.

9. The rotary holder of claim 1, wherein the complementary fixing mechanisms function as an elastic friction-fit connection.

10. The rotary holder of claim 1, wherein the complementary fixing mechanisms comprise a female fixing element located on the closing cap and a male fixing element located on the rotatable body.

11. The rotary holder of claim 10, wherein the female element comprises an annular groove located at a lower end of the closing cap and on an inner surface of a peripheral wall of the closing cap, and wherein the male element comprises an annular bead arranged on an outer surface of a peripheral wall of the rotatable body.

12. The rotary holder of claim 1, wherein the rotatable body and the closing cap are made of plastic.

13. The rotary holder of claim 1, wherein the closing cap comprises an internal wall portion, the internal wall portion comprising one complementary fixing mechanism of the complementary fixing mechanisms.

14. The rotary holder of claim 1, wherein the closing cap comprises a cylindrical wall portion having an inner cylindrical surface, the inner cylindrical surface comprising one complementary fixing mechanism of the complementary fixing mechanisms.

15. The rotary holder of claim 14, wherein the rotatable body comprises a cylindrical wall having an outer cylindrical surface, the outer cylindrical surface comprising another complementary fixing mechanism of the complementary fixing mechanisms.

16. The rotary holder of claim 1, wherein the rotatable body comprises a cylindrical wall having an inner cylindrical surface, the inner cylindrical surface comprising another complementary fixing mechanism of the complementary fixing mechanisms.

17. A rotary holder for a cosmetic product, comprising:

a base;

a rotatable body that is rotatably mounted on the base;

a cursor which is driven in longitudinal translation by rotational movement of the rotatable body;

a closing cap which is directly and removably affixable to the rotatable body;

complementary fixing mechanisms allowing the closing cap to be removably and directly affixed to the rotatable body; and the complementary fixing mechanisms facilitating affixation between the closing cap and the rotatable body with respect to a longitudinal axis of the holder and preventing respective translation between the closing cap and the rotatable body, wherein, when the closing cap is installed on the rotatable body, the closing cap is free to rotate about the longitudinal axis, wherein the closing cap comprises an internal wall portion, the internal wall portion comprising one complementary fixing mechanism of the complementary fixing mechanisms, and wherein the rotatable body comprises a cylindrical wall having an inner cylindrical surface, the inner cylindrical surface comprising another complementary fixing mechanism of the complementary fixing mechanisms.

18. A rotary holder for a cosmetic product, comprising:

a base having an internal opening;

a cylindrical body having an internal opening, a first end and a second end that is rotatably mounted to one end of the base;

a cursor which is driven in longitudinal translation by rotational movement of the cylindrical body;

the cursor being movable within the openings of the base and the cylindrical body;

a closing cap which is directly and removably affixable to the cylindrical body, the closing cap being slidable over the first end of the cylindrical body;

a first fixing mechanism arranged on a cylindrical surface of the closing cap;

a second fixing mechanism arranged on a cylindrical surface of the cylindrical body;

the first and second fixing mechanism cooperating to allow the closing cap to be removably and directly affixed to the cylindrical body; and the first and second fixing mechanisms facilitating affixation between the closing cap and the cylindrical body with respect to a longitudinal axis of the holder and preventing respective translation between the closing cap and the cylindrical body, wherein, when the closing cap is installed on the cylindrical body, the closing cap is free to rotate about the longitudinal axis, wherein the first fixing mechanism comprises an annular groove located at a lower end of the closing cap and on an inner surface of a peripheral wall of the closing cap, and wherein the second fixing mechanism comprises an annular bead arranged on an outer surface of a peripheral wall of the cylindrical body.

19. A rotary holder for a cosmetic product, comprising:

a base having an internal cylindrical opening;

a cylindrical body having an internal cylindrical opening, a cylindrical wall, a first end and a second end that is rotatably mounted to one end of the base;

a cursor which is driven in longitudinal translation by rotational movement of the cylindrical body;

the cursor being movable within the cylindrical openings of the base and the cylindrical body;

a cylindrical closing cap which is directly and removably affixable to the cylindrical body, the cylindrical closing cap being slidable over the first end of the cylindrical body;

a first fixing mechanism arranged on a cylindrical surface of the cylindrical closing cap, the cylindrical surface being one of an inner cylindrical surface of an outer cylindrical wall and an outer cylindrical surface of an inner cylindrical wall;

a second fixing mechanism arranged on a cylindrical surface of the cylindrical body, the cylindrical surface being one of an outer cylindrical surface of the cylindrical wall and an inner cylindrical surface of the cylindrical wall;

the first and second fixing mechanisms cooperating to allow the cylindrical closing cap to be removably and directly affixed to the cylindrical body; and the first and second fixing mechanisms facilitating affixation between the cylindrical closing cap and the cylindrical body with respect to a longitudinal axis of the holder and preventing respective translation between the cylindrical closing cap and the cylindrical body, wherein, when the cylindrical closing cap is installed on the cylindrical body, the cylindrical closing cap is free to rotate about the longitudinal axis, wherein the first fixing mechanism comprises an annular groove and wherein the second fixing mechanism comprises an annular bead.

* * * * *